US007327355B2

(12) United States Patent
Shin et al.

(10) Patent No.: US 7,327,355 B2
(45) Date of Patent: Feb. 5, 2008

(54) LCD MONITOR WITH DUAL INTERFACE AND CONTROL METHOD THEREOF

(75) Inventors: Seung-gi Shin, Suwon (KR); Eun-bae Lee, Suwon (KR); Jong-hwa Bae, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 397 days.

(21) Appl. No.: 10/279,877

(22) Filed: Oct. 25, 2002

(65) Prior Publication Data

US 2003/0107562 A1 Jun. 12, 2003

(30) Foreign Application Priority Data

Dec. 8, 2001 (KR) ..... 10-2001-77643
May 3, 2002 (KR) ..... 10-2002-24409

(51) Int. Cl.
*G09G 5/00* (2006.01)

(52) U.S. Cl. ..... 345/204; 345/3.1; 345/211

(58) Field of Classification Search ..... 345/3.4, 345/3.3, 211, 572, 581, 596, 3.1, 204, 87, 345/1.2, 104; 710/2
See application file for complete search history.

(56) References Cited

U.S. PATENT DOCUMENTS 5,508,714 A * 4/1996 Zenda ..... 345/3.3
5,757,338 A * 5/1998 Bassetti et al. ..... 345/3.2
5,949,437 A 9/1999 Clark
5,963,193 A * 10/1999 Knox et al. ..... 345/601
5,986,636 A * 11/1999 Wu ..... 345/691
6,028,585 A * 2/2000 Ishii et al. ..... 345/581
6,115,032 A * 9/2000 Kotha et al. ..... 345/211
6,118,413 A * 9/2000 Bril et al. ..... 345/596
6,343,957 B1 2/2002 Kuo et al.
6,490,005 B1 * 12/2002 Steinbach et al. ..... 348/572
6,577,303 B2 * 6/2003 Kim ..... 345/212
6,721,881 B1 * 4/2004 Bian et al. ..... 713/1
6,804,724 B2 * 10/2004 Shin ..... 710/2
6,943,753 B2 * 9/2005 Shirasaki et al. ..... 345/3.1
2001/0004257 A1 * 6/2001 Nitta et al. ..... 345/211
2003/0043140 A1 * 3/2003 Ko et al. ..... 345/211

FOREIGN PATENT DOCUMENTS

JP 2000-89930 3/2000
JP 2001-125693 5/2001
JP 2001-175230 6/2001
KR 2001-94426 11/2001

* cited by examiner

*Primary Examiner*—Jimmy H. Nguyen
(74) *Attorney, Agent, or Firm*—Staas & Halsey LLP

(57) ABSTRACT

An LCD monitor with a dual interface, having a DVI-I connector through which digital and analog video signals from a computer main body are input, and digital and analog display modes according to the type of the input video signal. The monitor includes a signal sensing part to sense the video signal input through the DVI-I connector; and a control part to adapt the display mode for the type of video signal input when the computer main body is performing system booting, based upon the sensing result of the signal sensing part. The present invention provides an LCD monitor with a dual interface and a control method thereof, which can display a system booting screen even if a video signal input when the computer system is performing a system booting is unfit for a preset display mode.

13 Claims, 4 Drawing Sheets

LCD MONITOR WITH DUAL INTERFACE AND CONTROL METHOD THEREOF

CROSS-REFERENCE TO RELATED APPLICATIONS

This application claims the benefit of Korean Application No. 2001-77643, filed Dec. 8, 2001 and Korean Application No. 2002-24409, filed May 3, 2002, in the Korean Industrial Property Office, the disclosures of which are incorporated herein by reference.

BACKGROUND OF THE INVENTION

1. Field of the Invention

The present invention relates to an LCD monitor with a dual interface and a control method thereof, and more particularly, to an LCD monitor which can display a system booting screen, even if a video signal input when a computer system is in system booting mode is unfit for a preset display mode.

2. Description of the Related Art

An LCD (liquid crystal display) monitor occupies a relatively small space in comparison with a CRT (cathode ray tube) monitor, and has a digital interface which can directly process digital data output from a computer main body without signal loss, thereby realizing a high definition picture. However, the CRT monitor processes only analog data, and therefore a graphic card applied to the CRT monitor must convert the digital data into the analog data before transmitting data to the CRT monitor.

To make the graphic card for the CRT monitor compatible with the LCD monitor, there has been proposed an LCD monitor having a dual interface for digital and analog data. A DVI-I (digital video interface-I) interface is an example of the dual interface, and the LCD monitor can process both digital and analog data through the DVI-I interface. Thus, the LCD monitor having the dual interface is operated in an analog display mode or a digital display mode which is previously set by a user according to the graphic card, or is operated in a default mode in the absence of a preset display mode.

As a digital graphic card to output a digital video signal, there is proposed a graphic card which outputs an analog video signal when a computer system is in BIOS (basic input/output system) booting, and outputs a digital video signal after WINDOWS® booting. In the case of the graphic card, a user sets the LCD monitor to be operated in the digital display mode, so that the LCD monitor cannot display a BIOS-booting screen because the analog signal is output when the computer system is in BIOS-booting. Herein, BIOS-booting and WINDOWS® booting are collectively called system booting.

FIG. 4 is a flow diagram of the LCD monitor having the conventional dual interface. In the LCD monitor wherein the display mode is the digital display mode, set by the user or as a default mode, when the computer main body and the LCD monitor are turned on (P10), the computer main body starts the system booting (P12). During the system booting, the computer main body transmits a system booting video signal to the LCD monitor so as to display the system booting screen. Herein, the system booting video signal is output as an analog signal or a digital signal according to the graphic card.

Then, because the LCD monitor is turned on under the digital display mode, the LCD monitor determines whether a system booting video signal is input through a digital video signal port or not (P14).

When the system booting video signal is output from the computer main body as the digital signal, the LCD monitor processes the system booting video signal under the digital display mode (P16), and displays the system booting screen (P18).

However, when the system booting video signal is output from the computer main body as an analog signal, the LCD monitor enters a DPMS (display power management signaling) mode because the LCD monitor cannot receive the digital signal (P20). In this case, the user cannot see the system booting screen, and therefore cannot check the state of the computer system.

Particularly, in the case in which the user uses a computer system which is set to require a password for security while the system is booting, a user must input the password through a monitor operating under the analog display mode, and use another monitor operating under the digital display mode after the system booting.

Furthermore, this problem occurs while the computer system is "awakened" from a power saving mode. Consequently, the LCD monitor operating under the digital display mode cannot display an analog video signal output from the computer main body.

On the other hand, though the LCD monitor is set by the analog display mode, if the graphic card outputs the digital signal when the computer system is performing system booting, the LCD monitor cannot display the system booting screen, and another monitor operating under the digital display mode is needed to input the password.

SUMMARY OF THE INVENTION

Accordingly, it is an object of the present invention to provide an LCD monitor with a dual interface and a control method thereof, which can display a system booting screen even if a video signal input when a computer system is performing system booting is unfit for a preset display mode.

Additional objects and advantages of the invention will be set forth in part in the description which follows, and, in part, will be obvious from the description, or may be learned by practice of the invention.

The foregoing and other objects of the present invention are achieved by providing an LCD monitor with a dual interface, through which a video signal being a digital or an analog video signal is input from a computer main body, and having a display mode being a digital or an analog display mode according to whether the input video signal is analog or digital, including a DVI-I connector to receive the input video signal; a signal sensing part to sense the video signal received by the DVI-I connector; and a control part to adapt the display mode according to whether the sensing part senses that the video signal is analog or digital when the computer main body is performing a system booting.

According to an aspect of the present invention, the control part converts the display mode into the analog display mode when the LCD monitor is set to the digital display mode and the digital video signal is not sensed by the signal sensing part when the computer main body is performing the system booting.

According to another aspect of the present invention, the control part converts the display mode into the digital display mode when the LCD monitor is set to the analog display mode and the analog video signal is not sensed by the signal sensing part when the computer main body is performing the system booting.

The foregoing and other objects of the present invention may also be achieved by providing an LCD monitor with a dual interface through which a video signal being a digital or an analog video signal is input from a computer main body, and having a display mode being a digital or an analog display mode according to whether the input video signal is analog or digital, including a DVI-I connector to receive the input video signal; a signal sensing part to sense the video signal received by the DVI-I connector; and a control part to convert the display mode into the analog display mode when the LCD monitor is preset to the digital display mode and the analog video signal is sensed by the signal sensing part when the computer main body is performing a system booting, and to convert the display mode into the digital display mode when the system booting is completed.

According to an aspect of the present invention, the control part converts the display mode into the analog display mode when the LCD monitor is preset to the digital display mode and the analog video signal is sensed by the signal sensing part while the computer main body is taken out of a power saving mode, and converts the display mode into the digital display mode when the computer main body comes into a normal mode from the power saving mode.

The foregoing and other objects of the present invention may also be achieved by providing a method of controlling an LCD monitor with a dual interface, having a DVI-I connector through which a video signal being a digital or an analog video signal is input from a computer main body, and having a display mode being a digital or an analog display mode according to the input video signal, the method including checking a preset display mode when the computer main body is performing a system booting, sensing the video signal input through the DVI-I connector, and converting the preset display mode into the display mode according to the sensed video signal.

According to an aspect of the present invention, the converting of the preset display mode includes converting the preset display mode into the digital display mode when the preset display mode is the analog display mode and the analog video signal is not input when the computer main body is performing the system booting.

The converting of the display mode may include converting the preset display mode into the analog display mode when the preset display mode is the digital display mode and the digital video signal is not input when the computer main body is performing the system booting.

The foregoing and other objects of the present invention may also be achieved by providing a method of controlling an LCD monitor with a dual interface, having a DVI-I connector through which a video signal being a digital or an analog video signal is input from a computer main body having a display mode being a digital or an analog display mode according to the input video signal, the method including turning on the LCD monitor and the computer main body in a preset digital display mode; sensing whether the video signal input through the DVI-I connector when the computer main body is in a system booting is the digital video signal; and sensing whether the video signal is input through the DVI-I connector if the digital video signal is not sensed; converting the display mode into the analog display mode if the analog video signal is sensed; and converting the display mode into the digital display mode when the system booting is completed.

The foregoing and other objects of the present invention may also be achieved by providing a method of controlling an LCD monitor with a dual interface, having a DVI-I connector through which a video signal being a digital or an analog video signal is input from a computer main body having a display mode being a digital or an analog display mode according to the input video signal, the method including turning on the LCD monitor and the computer main body in a preset digital display mode; sensing whether the video signal input through the DVI-I connector while the computer main body is taken out of a power saving mode; sensing whether the analog video signal is input through the DVI-I connector if the digital video signal is not sensed; converting the display mode into the analog display mode if the analog video signal is sensed; and converting the display mode into the digital display mode when the computer main body comes into a normal mode from the power saving mode.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
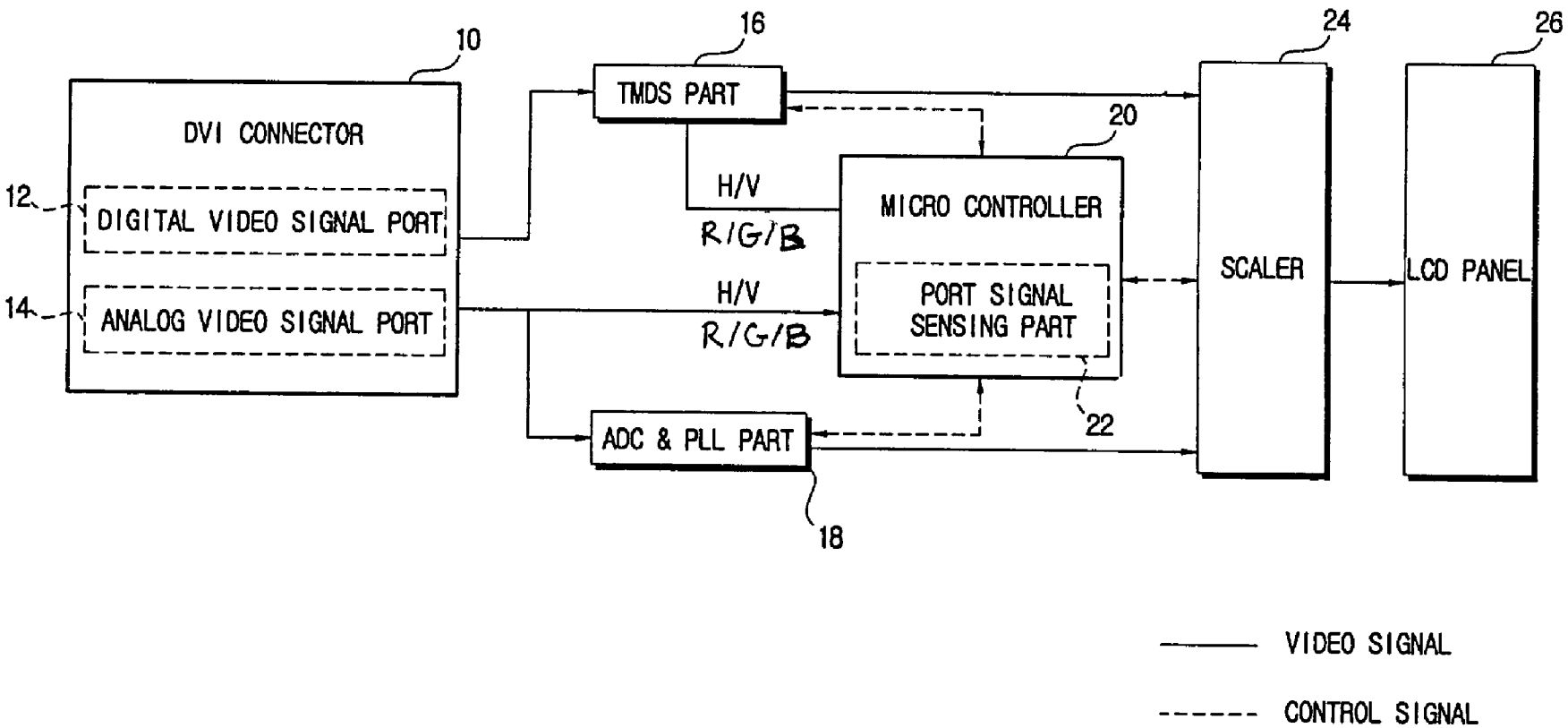
FIG. 1 is a block diagram of an LCD monitor having a dual interface according to an embodiment of the present invention.

Reference will now be made in detail to the present preferred embodiments of the present invention, examples of which are illustrated in the accompanying drawings, wherein like reference numerals refer to like elements throughout.

FIG. 1 is a block diagram of an LCD monitor with a dual interface according to an embodiment of the present invention. The LCD monitor includes a DVI connector 10 through which digital and analog video signals output from a computer main body (not shown) are input, a TMDS (transition minimized differential signaling) part 16 which processes the digital video signals input through the DVI connector 10, an ADC&PLL (analog/digital converter & phase lock loop) part 18 which processes the analog video signals input through the DVI connector 10, and a scaler 24 which adapts the processed video signal to the size of an LCD panel 26. The LCD monitor further includes a micro controller 20 which controls the TMDS part 16 and the ADC&PLL part 18 according to the video signal input through the DVI connector 10 so as to display a picture on the LCD panel 26.

The DVI connector 10 is provided with a digital video signal port 12 which receives the digital video signal output from the computer main body, and an analog video signal port 14 which receives the analog video signal output from the computer main body.

The TMDS part 16 decompresses the digital video signal input through the digital video signal port 12 of the DVI connector 10, and transmits H/V_sync (horizontal and vertical synchronous) signals and digital R/G/B signals to the micro controller 20 and the scaler 24, respectively.

The ADC&PLL part 18 converts the analog video signal input through the analog video signal port 14 of the DVI connector 10 into the digital R/G/B signals, and transmits the digital R/G/B signals to the scaler 24.

The scaler 24 adapts the R/G/B signals transmitted from the TMDS part 16 or the ADC&PLL part 18 to the size of the LCD panel 26, and displays a picture on the LCD panel 26.

The micro controller 20 includes a port signal sensing part 22 to sense whether a video signal is input through the digital video signal port 12 or the analog video signal port 14. Thus, the micro controller 20 senses each port through the port signal sensing part 22, thereby determining what kind of video signal is input.

When the digital video signal is input, the micro controller 20 controls the TMDS part 16 and displays a picture on the LCD panel 26 according to the digital video signal. When the analog video signal is input, the micro controller 20 controls the ADC&PLL part 18 and displays a picture on the LCD panel 26 according to the analog video signal. Thus, a system booting screen is displayed on the LCD panel 26 even if the analog signal is output when the computer system is performing system booting.

Figure 2:
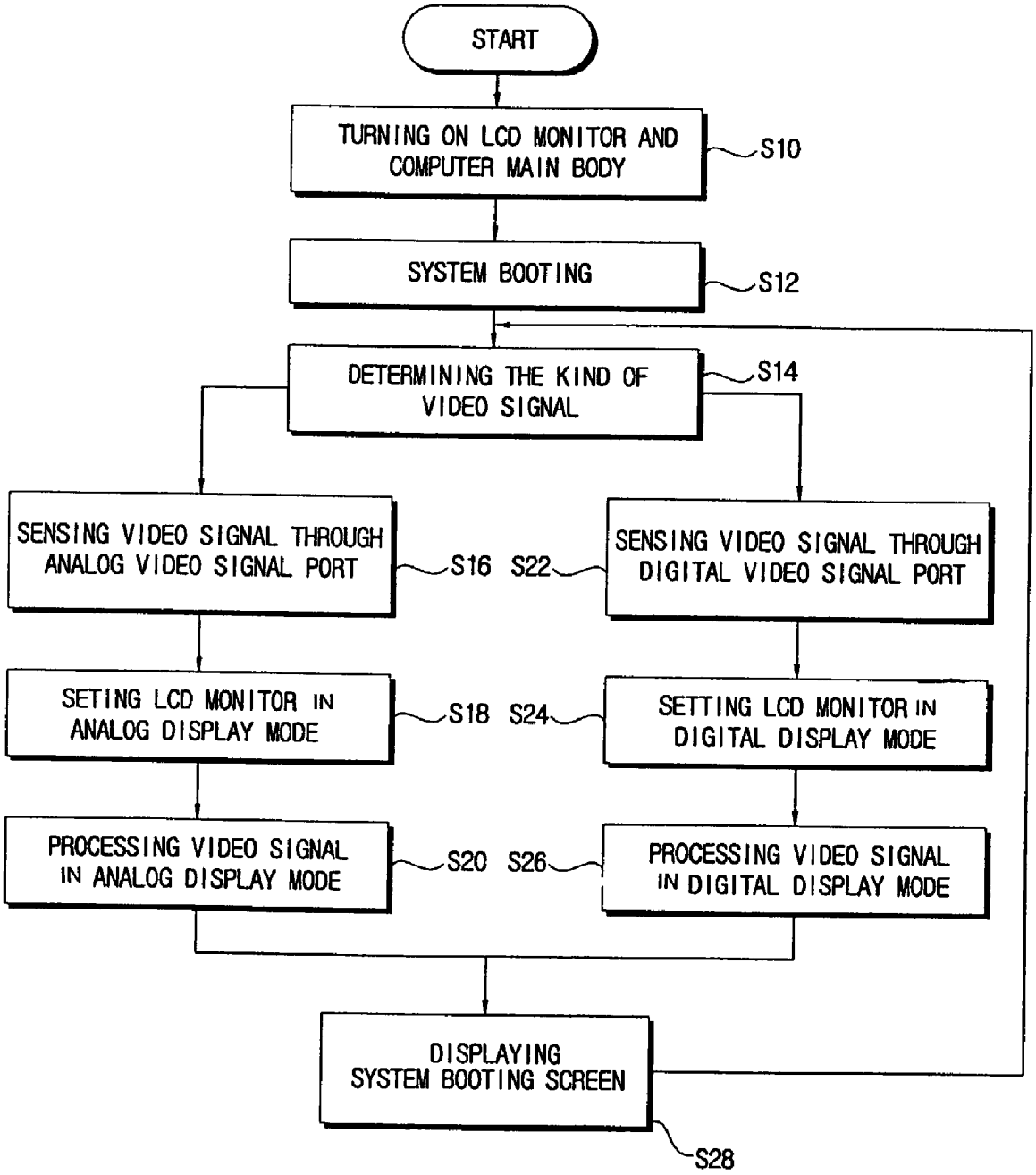
FIG. 2 is a flow diagram of the operation of the micro-controller of FIG. 1 when a user does not set the display mode.

FIG. 2 is a flow diagram of the operation of the micro controller 20. When the LCD monitor and the computer main body are turned on (S10), the computer main body starts the system booting (S12). While performing the system booting, the computer main body transmits a system booting video signal to display the system booting screen on the LCD monitor. The micro controller 20 determines what kind of video signal is input through the DVI connector 10 by sensing the port signal sensing part 22 (S14).

When the port signal sensing part 22 senses the system booting video signal input through the analog video signal port 14 (S16), the micro controller 20 sets the LCD monitor in the analog display mode (S18). After the LCD monitor is set in the analog display mode, the micro controller 20 controls the ADC&PLL part 18 and the scaler 24, thereby displaying the system booting screen on the LCD panel 26 according to the analog video signal input through the analog video signal port 14 (S20). Thus, the system booting screen is displayed on the LCD panel 26 according to the analog video signal (S28).

When the port signal sensing part 22 senses the system booting video signal input through the digital video signal port 12 (S22), the micro controller 20 sets the LCD monitor in the digital display mode (S24). After the LCD monitor is set in the digital display mode, the micro controller 20 controls the TMDS part 16, thereby displaying the system booting screen on the LCD panel 26 according to the digital video signal input through the digital video signal port 12 (S26). Thus, the system booting screen is displayed on the LCD panel 26 according to the digital video signal (S28).

When the system booting is completed after displaying the system booting screen, the micro controller 20 determines again what kind of video signal is input through the port signal sensing part 22 (S14). Then, the micro controller 20 converts the display mode of the LCD monitor into the digital display mode or the analog display mode according to the type of the determined video signal, thereby displaying a picture on the LCD panel 26 according to the video signal output from the computer main body.

Alternately, a user can selectively set the LCD monitor in the digital display mode or the analog display mode, and the display mode set by the user is input to the micro controller 20. According to the display mode set by the user, the micro controller 20 selectively controls the TMDS part 16 or the ADC&PLL part 18, and displays a picture on the LCD panel 26 according to the digital video signal or the analog video signal.

Furthermore, when a user sets the display mode of the LCD monitor, the micro controller 20 determines what kind of video signal is input through the port signal sensing part 22 when the LCD monitor is turned on, and performs the control according to the determination.

Figure 3:
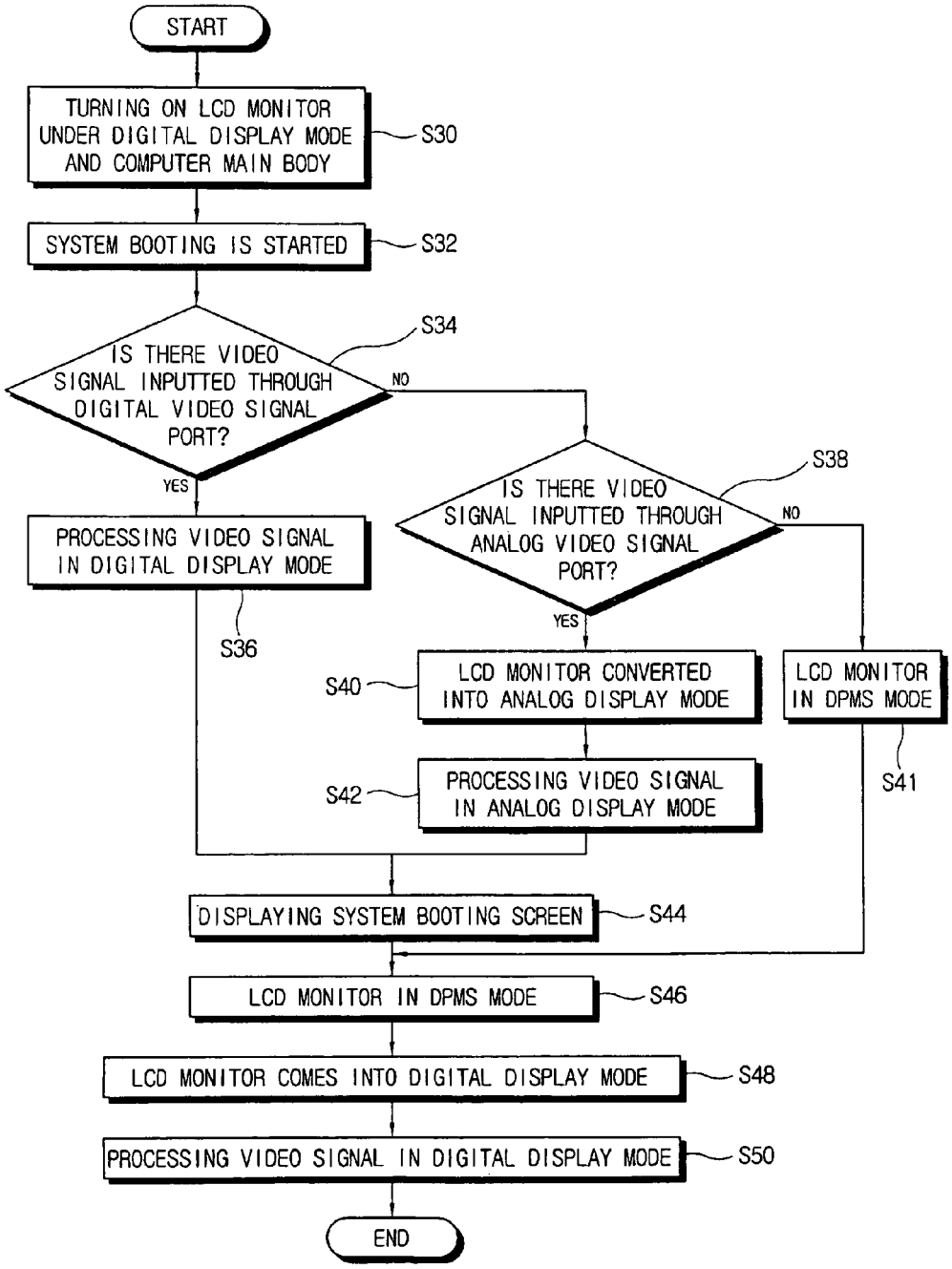
FIG. 3 is a flow diagram of the operation of the micro-controller of FIG. 1 when a user sets the display mode.
Figure 4:
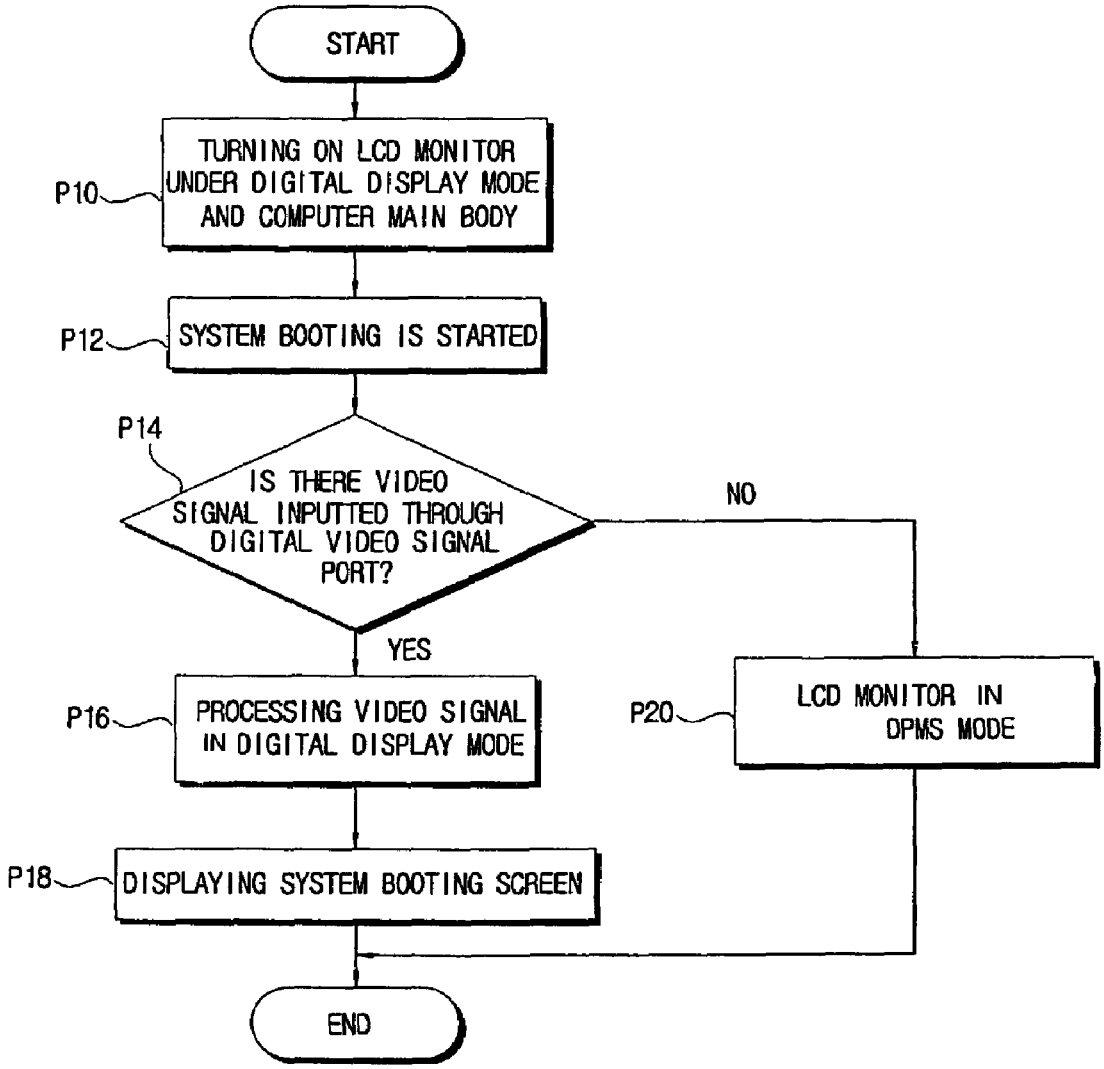
FIG. 4 (PRIOR ART)
FIG. 4 is a flow diagram of an LCD monitor having the conventional dual interface.

FIG. 3 is a flow diagram of the operation of the micro controller 20 when the user sets the display mode of the LCD monitor. In operation S30, the preset or default display mode is a digital display mode. The computer main body and the LCD monitor are turned on (S30), and the computer main body starts the system booting (S32). While performing system booting, the computer main body transmits a system booting video signal to the LCD monitor to display the system booting screen. Herein, the micro controller 20 of the LCD monitor determines what kind of video signal is input by sensing the digital video signal port 12 of the port signal sensing part 22 (S34).

When the port signal sensing part 22 senses the system booting video signal is input through the digital video signal port 12, the micro controller 20 operates under the digital display mode, i.e., controls the TMDS part 16 (S36), thereby displaying the system booting screen (S44).

On the other hand, when the system booting video signal is not sensed through the digital video signal port 12 by the port signal sensing part 22, the micro controller 20 determines whether the system booting video signal is input through the analog video signal port 14 (S38).

When it is determined that the system booting video signal is input through the analog video signal port 14, the micro controller 20 converts the preset digital display mode into the analog display mode (S40). As the digital display mode is converted into the analog display mode, the micro controller 20 controls the ADC&PLL part 18 to process the system booting video signal input through the analog video signal port 14 (S42), thereby displaying the system booting screen (S44).

In operation S38, when it is determined that the system booting video signal is also not input through the analog video signal port 14, it is determined that there is no video signal, and the micro controller 20 places the LCD monitor in a DPMS (display power management signaling) mode (S41).

After the system booting is completed (S46), an OS (operating system) program (e.g. WINDOWS®) is executed and the digital video signal is output. Therefore, when the computer main body completes the system booting, the micro controller 20 converts the display mode into the preset display mode, namely the digital display mode (S48). As the display mode is converted into the digital display mode, the micro controller 20 controls the TMDS part 16 to process a WINDOWS® video signal input through the digital video signal port 12 (S50), thereby displaying a WINDOWS® screen.

As described above, according to the present invention, in the LCD monitor having the dual interface which can process both digital and analog video signals, the display mode thereof is converted depending upon the kind of a video signal input when the computer system is performing system booting, so that the system booting screen is displayed even if the video signal unfit for the preset display mode is input. Furthermore, the present invention can be applied while the computer system is taken out of a power saving mode.

Thus, in the computer system including the LCD monitor preset in the digital display mode, even if the computer main body outputs an analog video signal while the computer system is taken out of a power saving mode, the LCD monitor can display a picture. Therefore, when a password is required to get out of the power saving mode, the LCD monitor can display a password input screen according to the analog video signal, thereby allowing the user to input the password through the password input screen.

As described above, the present invention provides an LCD monitor with a dual interface and a control method thereof, which can display a system booting screen even if a video signal input when a computer system is in system booting is unfit for a preset display mode.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A liquid crystal display (LCD) monitor with a dual interface, through which a video signal being a digital or an analog video signal is input from a computer main body, having a display mode being a digital or an analog display mode according to whether the input video signal is analog or digital, comprising:

a digital video interface—integrated (DVI-I) connector to receive the input video signal;

a signal sensing part to sense the video signal from the computer main body received by the DVI-I connector; and a control part to adapt the display mode according to whether the signal sensing part senses that the video signal is analog or digital when the computer main body is performing a system booting, wherein the control part converts the display mode into the analog display mode when the LCD monitor is set to the digital display mode and only an analog video signal is sensed by the signal sensing part when the computer main body is performing the system booting.

2. The LCD monitor with the dual interface according to claim 1, wherein the control part converts the display mode into the digital display mode when the LCD monitor is set to the analog display mode and the analog video signal is not sensed by the signal sensing part when the computer main body is performing the system booting.

3. A liquid crystal display (LCD) monitor with a dual interface, through which a video signal being a digital or an analog video signal is input from a computer main body, having a display mode being a digital or an analog display mode according to whether the input video signal is analog or digital, comprising:

a digital video interface—integrated (DVI-I) connector to receive the input video signal;

a signal sensing part to sense the video signal from the computer main body received by the DVI-I connector; and a control part to convert the display mode into the analog display mode when the LCD monitor is preset to the digital display mode and the analog video signal is sensed by the signal sensing part when the computer main body is performing a system booting, and to convert the display mode into the digital display mode when the system is booting.

4. The LCD monitor with the dual interface according to claim 3, wherein the control part converts the display mode into the analog display mode when the LCD monitor is preset to the digital display mode and the analog video signal is sensed by the signal sensing part while the computer main body is taken out of a power saving mode, and converts the display mode into the digital display mode when the computer main body comes into a normal mode from the power saving mode.

5. A method of controlling a liquid crystal display (LCD) monitor with a dual interface, having a digital video interface—integrated (DVI-I) connector through which a video signal being a digital or an analog video signal is input from a computer main body, and having a display mode being a digital or an analog display mode according to the input video signal, the method comprising:

presetting the display mode;

checking the preset display mode when the computer main body is performing a system booting;

sensing the video signal from a computer main body input through the DVI-I connector; and converting the preset display mode according to the sensed video signal, wherein, in the converting of the preset display mode, the preset display mode is converted into the digital display mode when the preset display mode is the analog display mode and the analog video signal is not input when the computer main body is performing the system booting.

6. A method of controlling a liquid crystal display (LCD) monitor with a dual interface, having a digital video interface—integrated (DVI-I) connector through which a video signal being a digital or an analog video signal is input from a computer main body, and having a display mode being a digital or an analog display mode according to the input video signal, the method comprising:

presetting the display mode;

checking the preset display mode when the computer main body is performing a system booting;

sensing the video signal from a computer main body input through the DVI-I connector; and converting the preset display mode according to the sensed video signal, wherein, in the converting of the preset display mode, the preset display mode is converted into the analog display mode when the preset display mode is the digital display mode and only an analog video signal is input when the computer main body is performing the system booting.

7. A method of controlling A liquid crystal display (LCD) monitor with a dual interface, having a digital video interface—integrated (DVI-I) connector through which a video signal being a digital or an analog video signal is input from a computer main body, and having a display mode being a digital or an analog display mode according to the input video signal, the method comprising:

turning on the LCD monitor in a preset digital display mode and turning on the computer main body;

sensing whether the video signal input from the computer main body through the DVI-I connector when the computer main body is in a system booting is the digital video signal;

sensing whether the video signal is input through the DVI-I connector if the digital video signal is not sensed; and converting the preset digital display mode into the analog display mode if the analog video signal is sensed.

8. A method of controlling A liquid crystal display (LCD) monitor with a dual interface, having a digital video interface—integrated (DVI-I) connector through which a video signal being a digital or an analog video signal is input from a computer main body, and having a display mode being a digital or an analog display mode according to the input video signal, the method comprising:

turning on the LCD monitor in a preset digital display mode and turning on the computer main body;

sensing whether the video signal is input through the DVI-I connector while the computer main body is taken out of a power saving mode;

sensing whether the analog video signal is input through the DVI-I connector if the digital video signal is not sensed; and converting the preset digital display mode into the analog display mode if the analog video signal is sensed.

9. A liquid crystal display (LCD) monitor to display a video signal received from a computer according to a display mode of either an analog or a digital type, the video signal being of a digital or an analog type, the monitor comprising:

a connector to receive the video signal from the computer during a system booting of the computer; and a controller to control the display mode according to the type of the video signal, the video signal being displayed during the system booting even if the type of the display mode is different from the type of the video signal.

10. A system comprising:

a computer to generate a video signal, the video signal being a digital or an analog video signal; and a liquid crystal display (LCD) monitor to display the video signal according to either a digital or an analog display mode, the monitor comprising:

a connector to receive the video signal from the computer during a system booting of the computer, a sensor to sense whether the received video signal is analog or digital, and a controller to control the display mode according to whether the sensor senses that the video signal is analog or digital, wherein the control part converts the display mode into the analog display mode when the LCD monitor is set to the digital display mode and only an analog video signal is sensed by the signal sensing part when the computer main body is performing the system booting.

11. A method of displaying an image on a liquid crystal display (LCD) monitor with a dual interface in a display mode of a digital or an analog type, comprising:

generating a video signal from a computer, the video signal being a digital or an analog type;

receiving the video signal from the computer by the LCD monitor during a system booting of the computer;

sensing whether the received video signal is of the analog or the digital type; and converting the display mode to the type of the sensed video signal when the type of the sensed video signal is different from the type of the display mode.

12. The method according to claim 11, wherein the sensing comprises:

sensing whether the video signal is digital; and sensing whether the video signal is analog if the digital video signal is not sensed as being digital.

13. The method according to claim 11, wherein the sensing comprises:

sensing whether the video signal is analog; and sensing whether the video signal is digital if the analog video signal is not sensed as being analog.

* * * * *

UNITED STATES PATENT AND TRADEMARK OFFICE

CERTIFICATE OF CORRECTION

PATENT NO. : 7,327,355 B2
APPLICATION NO. : 10/279877
DATED : February 5, 2008
INVENTOR(S) : Seung-gi Shin et al.

It is certified that error appears in the above-identified patent and that said Letters Patent is hereby corrected as shown below:

Column 8, Line 52, change “A” to --a--.

Column 9, Line 3, change “A” to --a--.

Signed and Sealed this

Fifteenth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,327,355 B2
APPLICATION NO. : 10/279877
DATED : February 5, 2008
INVENTOR(S) : Seung-gi Shin et al.

It is certified that error appears in the above-identified patent and that said Letters Patent is hereby corrected as shown below:

Column 10, Line 8, replace “control part” with --controller--.
Column 10, Line 11, replace “signal sensing part” with --sensor--.

Signed and Sealed this
First Day of March, 2011

David J. Kappos

David J. Kappos
*Director of the United States Patent and Trademark Office*